United States Patent [19]

Jordan

[11] 4,147,311

[45] Apr. 3, 1979

[54] TAPE/CAPSTAN FEED UNIT

[75] Inventor: Kenneth A. Jordan, Oadby, United Kingdom

[73] Assignee: Trip Lite Ltd., South Wigston, United Kingdom

[21] Appl. No.: 856,230

[22] Filed: Dec. 1, 1977

Related U.S. Application Data

[63] Continuation-in-part of Ser. No. 700,039, Jun. 25, 1976, abandoned.

[30] Foreign Application Priority Data

Aug. 15, 1975 [GB] United Kingdom ..... 34161/75

[51] Int. Cl.[2] ..... B65H 51/20; B65H 51/26

[52] U.S. Cl. ..... 242/47.01; 242/47.08

[58] Field of Search ..... 242/47.01, 47.08, 47.09, 242/47.12; 66/132 T, 132 R

[56] References Cited

U.S. PATENT DOCUMENTS

| | | | |
|---|---|---|---|
| 2,694,860 | 11/1954 | McIntosh | 242/47.01 X |
| 3,575,018 | 4/1971 | Levin et al. | 66/132 T |
| 3,651,668 | 3/1972 | Pernick | 242/47.01 X |
| 3,747,863 | 7/1973 | Klementz et al. | 242/47.08 |
| 3,802,228 | 4/1974 | Deniega | 242/47.01 X |
| 3,922,887 | 12/1975 | Mishcon | 242/47.01 X |

*Primary Examiner*—Stanley N. Gilreath

*Attorney, Agent, or Firm*—Jones, Thomas & Askew

[57] ABSTRACT

A method for feeding a yarn to a textile machine selectively under conditions of positive and capstan feed. The method comprises wrapping multiple turns of yarn around a feed wheel and a smooth, straight-sided upstanding member alongside the feed wheel and inclined to the rotary axis of the feed wheel, and driving the feed wheel by frictional contact with a flexible tape that extends over only a part of the axial extent of the feed wheel. The positive feed mode is established by passing the yarn repeatedly through the nip of the tape and feed wheel. The capstan feed mode is established by feeding the yarn way from the nip. In either mode, separation of successive turns of yarn is achieved by the upstanding member, and when guiding the yarn from one mode to the other there is an axial movement of the yarn turns over the upstanding member to obtain free and unobstructed re-positioning of those turns on the said member.

5 Claims, 9 Drawing Figures

TAPE/CAPSTAN FEED UNIT

This application is a continuation-in-part of applicant's copending application Ser. No. 700,039, filed June 25, 1976, now abandoned.

The invention relates to methods for feeding yarns at controlled rates to textile machinery such as knitting machinery.

PRIOR ART

It has previously been proposed to feed yarn to, for example, the various knitting stations of a multifeed circular knitting machine using a capstan tape feed device which comprises for each knitting station a driven feed wheel around which the yarn is passed for a number of turns. It is necessary to provide means for preventing successive turns of the yarn from riding over, or lapping, previous turns which would cause snatching and breakage of the yarn. To avoid the problem of the yarn lapping onto itself during feeding it is necessary in such an arrangement to advance the yarn axially along the feed wheel as the wheel rotates. Devices which have been proposed to advance the yarn axially in this way have included conveyor belts extending in the axial direction down the outer surface of the feed wheels, and reciprocating pins which move outwardly to engage yarn wrapped around the feed wheel, axially to advance the yarn along the feed wheel and inwardly for the return axial movement. U.S. Pat. No. 2,434,210 solves the problem by providing axially spaced guides alongside the feed wheel for positioning successive turns of the yarn at defined axial spacings. Such a solution is unsatisfactory, however, in that extreme care is needed in setting-up to ensure that the turns of yarn go into the correct one of the axially spaced guides.

It has also been proposed to feed a yarn positively to the needles using a positive feed device which comprises a number of driven wheels around which there is passed a flexible driving tape or band. The driving tape is driven in synchronism with the needle cylinder of the knitting machine so that its rate of travel is in direct proportion to the rate of rotation of the needle cylinder. Between the driving tape and each feed wheel is formed a nip through which the yarn is passed, so that the yarn is positively fed to the needles of the knitting machine at the same rate as the rate of travel of the tape. In such a device if the yarn were wrapped completely around the feed wheel so that it passes through the nip two or more times the same problem of lapping of consecutive turns would occur. The axially movable means for advancing successive turns of yarn along the feed wheel as the wheel rotates would also move the tape out of position, so that this method of avoiding lapping has not been available. It has therefore been proposed in U.S. Pat. No. 3,575,018 to avoid lapping by passing successive turns of yarn around successive convolutions of a spiral spring alongside the feed wheel, and taking the yarn out axially of the spring. This method is satisfactory except that no axial movement of the yarn on the feed wheel is permitted. The yarn cannot therefore be moved down the wheel out from the nip of the tape and wheel to disengage the positive feed. The device is therefore inflexible in application and is not always suitable for commercial use. Also care is needed in setting-up, to ensure that the yarn passes around the spring in the correct sequence so as to maintain an adequate spacing between successive turns of yarn on the wheel.

THE INVENTION

It is an object of the invention to provide a method of feeding yarn to textile machinery selectively under conditions of accurately controlled positive feed or at a rate controlled by demand from the said machinery (so-called capstan feed).

It is a further object of the invention to achieve such a method using apparatus that does not require undue precision in the setting-up operation.

It is a further object of the invention to improve the accuracy of the yarn delivery rate in the positive feed mode by passing the yarn repeatedly through the nip of a flexible driving tape and a feed wheel while maintaining the separation of successive turns of said yarn around the feed wheel.

It is a further object of the invention to transfer quickly and easily from one mode of yarn feeding to the other with the minimum of operator attention.

These and other objects are attained by the method of yarn feeding of the invention, which comprises (1) winding a number of turns of said yarn in a yarn path extending around a feed wheel and a smooth straight-sided upstanding member that is positioned alongside said feed wheel and inclined to the rotary axis of said feed wheel;

(2) driving said feed wheel by frictional contact with a flexible tape contacting a small arc of said feed wheel over only a part of the axial width of said feed wheel; and (3) selectively guiding the yarn turns to two distinct axial zones on said feed wheel, one such axial zone being a zone in which said yarn passes repeatedly on successive turns through the nip formed between said flexible tape and said feed wheel to achieve positive feed of said yarn, the other axial zone being a zone in which said yarn does not pass through said nip so as to achieve yarn feeding at a rate dictated by demand from the said machinery, and movement of the yarn turns from either axial zone to the other being accompanied by free and unobstructed re-positioning of the successive turns of yarn on said upstanding member.

In performance of the method, yarn is passed from a cone through a first yarn guide, around the wheel and upstanding member for a plurality of turns, in practice generally two or three complete turns, and through a second yarn guide to the textile machine. If the yarn passes repeatedly through the nip of the wheel and flexible tape it is positively fed to the textile machine, whereas if the yarn passes around the wheel and upstanding member above or below the tape the wheel acts only as a capstan, or normal furnishing wheel, for supplying yarn to the machine. By moving the first and optionally also the second yarn guides axially relative to the wheel and tape, at different times the yarn can be fed to the nip of the tape and wheel or to the wheel above or below the tape. The tape accordingly preferably spans only about half the axial width of the wheel, which may be the upper half or the lower half as convenient. Setting up may be easier if the tape contacts the lower half of the wheel, so that with the first guide in its upper position relative to the tape a new yarn can be wrapped around the free upper half of the wheel without obstruction. Moving the first guide to its lower position relative to the tape then causes positive feed automatically to be engaged.

It has surprisingly been found that as the yarn passes around the wheel and finger, the inclination of the finger causes a regular axial advancement of successive turns of yarn even when the turns pass through the nip of the tape and wheel, as in the positive feed mode, so that the situation is avoided whereby one turn of the yarn laps over a previous turn so as to interfere with the free withdrawal of the yarn. Moreover the yarn in use finds its own axial position on the finger so that the initial setting-up is easy, and does not involve careful positioning of successive turns of yarn.

Preferably the yarn guides are axially displaced from each other so that they are approximately level with the yarn as it is fed onto and taken from the wheel. The upstanding member may be in the same plane as the axis of the wheel but inclined to the axis, it may be in a plane parallel with a plane through the axis of the wheel but inclined to the axis, or it may be inclined to the axis of the wheel in both of the said planes. The former inclination is preferable as it is most easily reproducible and therefore most easily set up. The upstanding member need be inclined at only a small angle to the axis to achieve the desired result. In general, an inclination of 3° to 10° is sufficient. Preferably the angle of inclination is variable so that the regular advancement of successive turns of the yarn can be varied by an operator. This variation can be achieved, for example, by mounting the member pivotally and providing a cam for contacting the finger on one side of the pivot to vary the angle of inclination. The angle of inclination can thus be set to suit the particular yarn used. For example, a continuous filament yarn is much less liable to snatch when successive turns of yarn about the wheel are closely adjacent one another than is a staple yarn. When the feed wheel assembly of the invention is set up with a continuous filament yarn, therefore, a greater number of turns can be placed around the wheel than when it is set up with a staple yarn, and the angle of inclination of the upstanding member adjusted in each case to achieve a sufficient and equal spacing between successive turns of yarn.

The yarn passing from the first guide to the wheel may pass over or under the upstanding member, but any complete turns of yarn passing around the wheel and to the other guide must pass over the said member in order to achieve the regular advancement of the turns of yarn which avoids snatching and breakage of the yarn.

The invention is hereinafter particularly described, by way of example only, with reference to the drawings, of which:

Figure 5:
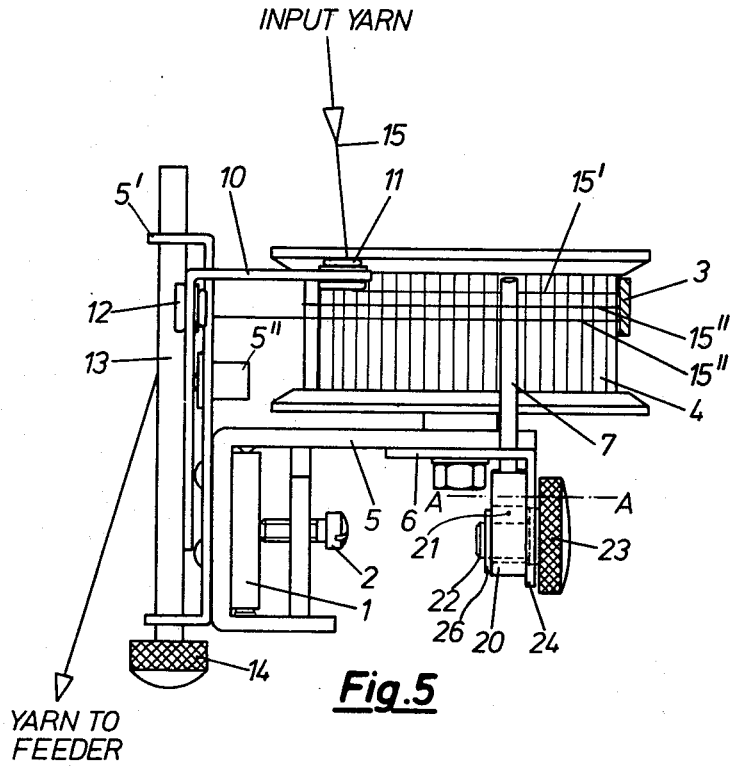
FIG. 5 is a side view, corresponding to that of FIG. 1, of an alternative device in which the angle of inclination of the finger is adjustable.
Figure 6:
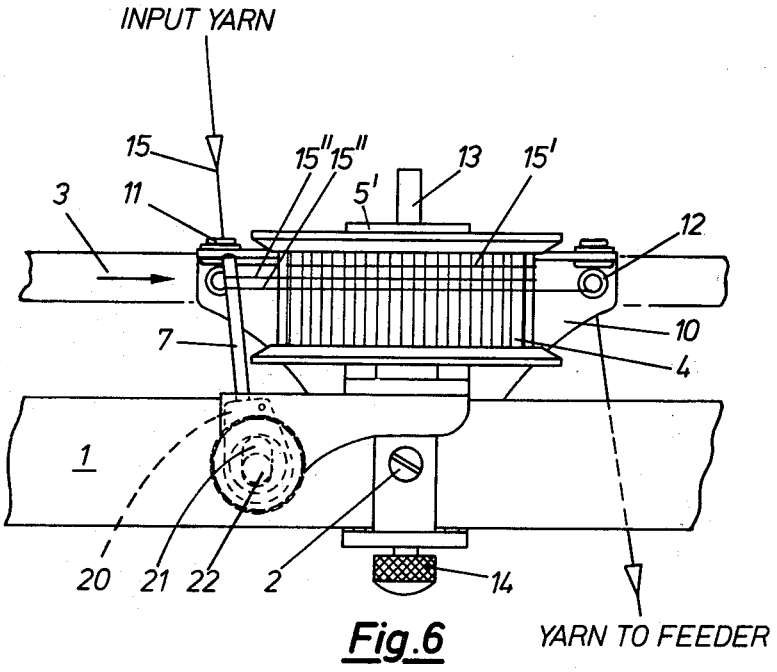
FIG. 6 is a front view corresponding to FIG. 5.
Figure 7:
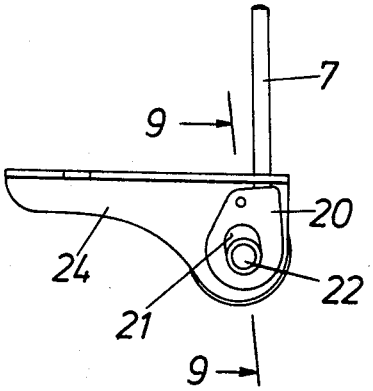
Figure 8:
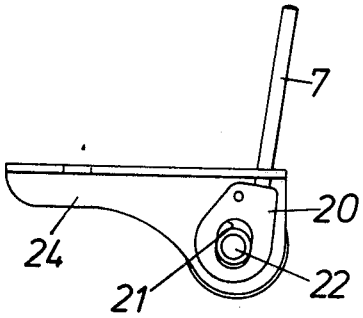
Figure 9:
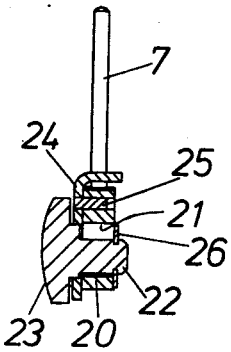

FIGS. 7 and 8 are rear views of the mounting of the adjustable finger of FIGS. 5 and 6, with the finger in alternative angular positions; and FIG. 9 is a section taken along the line 9—9 of FIG. 7.

In FIGS. 1 to 4 of the drawings the device is shown mounted on a rail 1 of a circular knitting machine by means of a screw 2. A tape 3 passes around a wheel 4 and around the corresponding wheels of a number of associated similar devices, the tape being driven at a rate directly proportional to the rate of rotation of the needle cylinder of the knitting machine. The arc of contact between the tape 3 and each wheel 4 subtends an angle of about 15° to 20° at the axis of the wheel so that each wheel is driven by the tape.

Figure 1:
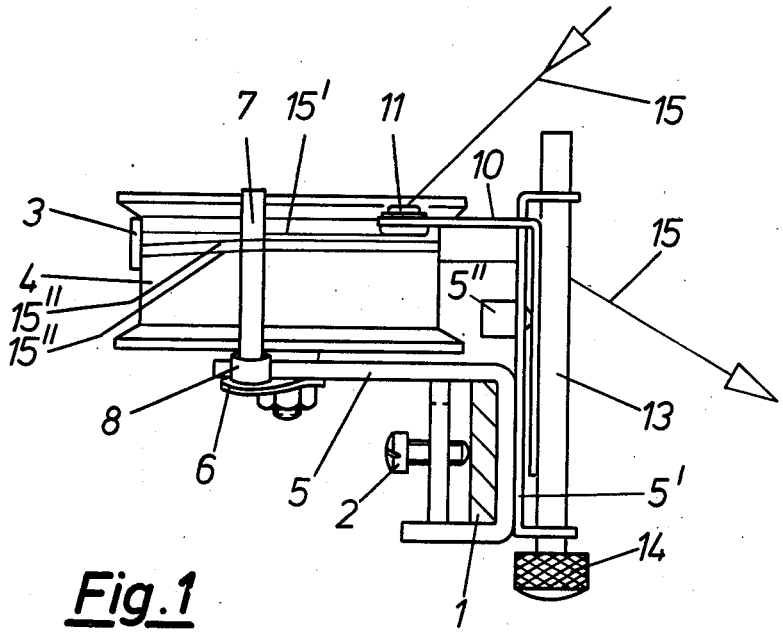
FIG. 1 is a side view of a device according to the invention with the guides in a position to feed yarn to the nip of the tape and wheel.
Figure 2:
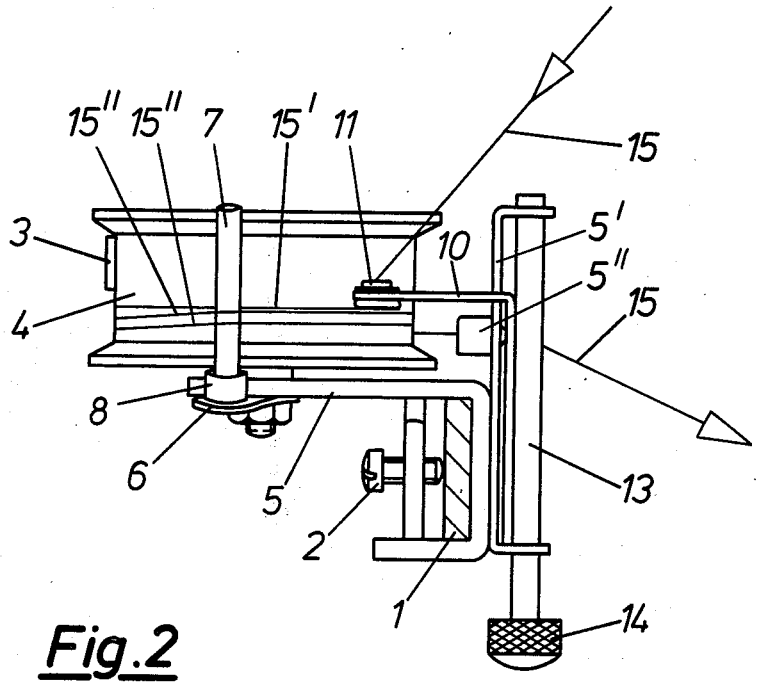
FIG. 2 is a side view of the device with the guides in a position to feed yarn below the nip.
Figure 3:
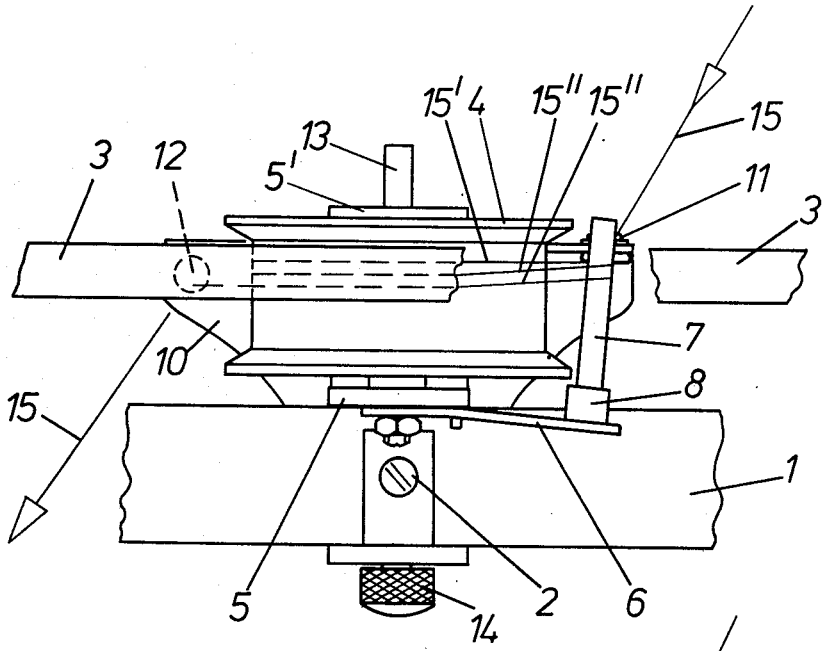
FIG. 3 is a front view corresponding to FIG. 1.
Figure 4:
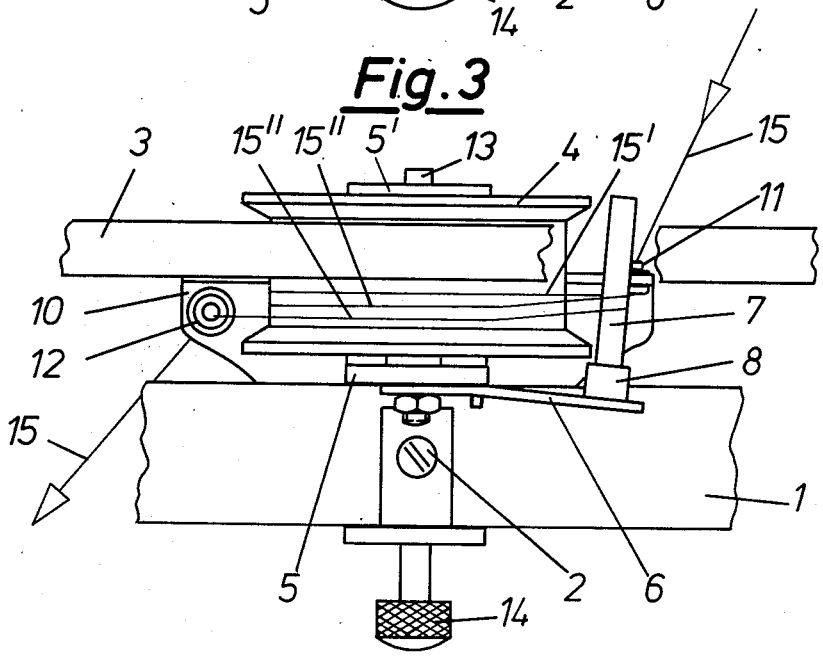
FIG. 4 is a front view corresponding to FIG. 2.

The wheel 4 is rotatably mounted on a frame 5 by means of bearings (not shown). The frame 5 also supports a mounting plate 6 for an upstanding finger 7. The mounting plate 6 terminates in a boss 8 in which the finger 7 is retained by means of a grub-screw (not shown). The finger 7 extends alongside the wheel 4 in a plane passing through the axis of the wheel 4 as seen in FIGS. 1 and 2, and is inclined to the axis of the wheel 4 as seen in FIGS. 3 and 4. The angle of inclination is approximately 50°. The finger 7 is formed of a hard smooth material such as hardened steel or a ceramic shell on a metal wire.

A subframe 10 mounts two ceramic yarn guide eyelets 11 and 12 for guiding yarn to and from the wheel 4, respectively. The subframe 10 is mounted on a shaft 13 slidable in a bracket portion 5' of the frame 5. The subframe 10 can be raised or lowered, by means of a knurled knob 14, between the two limiting positions shown in FIGS. 1 and 2. Positive location of the limiting positions is achieved by means of a spring-biased ball detent 5". In the upper position of the guide frame (FIGS. 1 and 3) yarn is fed to the nip formed between the wheel 4 and tape 3, and in the lower position of the guide frame (FIGS. 2 and 4) yarn is fed beneath the tape 3. The drawings also show a yarn 15, its direction of travel being indicated by arrowheads. From the first guide eyelet 11 the yarn 15 passes tangentially to the wheel 4 beneath the finger 7 as indicated at 15', and is then passed for two complete turns 15" around both the wheel and finger. Each turn is displaced axially from the previous turn(s) by virtue of the angular disposition of the finger 7 so that snatching of the yarn in use is avoided. The axial spacing of the guide eyelets 11 and 12 is such that the eyelet 11 is level with the yarn as it is fed to the wheel 4 and the eyelet 12 is approximately level with the yarn as it is fed from the wheel 4.

FIGS. 5 to 9 show a substantially similar device in which identical parts are given the same reference numbers. In FIGS. 5 and 6 the finger 7 is mounted on a boss 20 pivotable about a horizontal axis A—A (by means of a pivot pin 25 as shown in FIG. 9). A cam track 21 is formed in the boss 20 eccentrically of the pivotal axis of the boss and receives an eccentric cam 22 movable integrally with a knurled knob 23. The knob 23 is rotatably mounted on a side plate 24 so that rotation of the knob 23 and cam 22 causes small adjustments in the angular configuration of the finger 7. The knob 23 is retained in position on the side plate 24, and the boss 20 retained in position on the cam 22, by means of a circlip 26 around the end of the cam 22 remote from the knob. For clarity the circlip 26 is omitted from FIGS. 7 and 8.

What is claimed is:

1. A method of feeding yarn to textile machinery selectively under conditions of positive feed or at a rate dictated by demand from the said machinery, comprising the steps of:

(1) winding a number of turns of said yarn in a yarn path extending around a feed wheel and a smooth straight-sided upstanding member that is positioned alongside said feed wheel and inclined to the rotary axis of said feed wheel;

(2) driving said feed wheel by frictional contact with a flexible tape contacting a small arc of said feed wheel over only a part of the axial width of said feed wheel; and (3) selectively guiding the yarn turns to two distinct axial zones on said feed wheel, while maintaining axial spacing of said yarn turns, one such axial zone being a zone in which said yarn passes repeatedly on successive turns through the nip formed between said flexible tape and said feed wheel to achieve positive feed of said yarn, the other axial zone being a zone in which said yarn does not pass through said nip so as to achieve yarn feeding at a rate dictated by demand from the said machinery, and movement of the yarn turns from either axial zone to the other being accompanied by free and unobstructed re-positioning of the successive turns of yarn on said upstanding member.

2. A method according to claim 1, wherein the selective guidance of the yarn turns to the two distinct axial zones is achieved by movement of a subframe mounting guides for guiding said yarn to and from said feed wheel.

3. A method according to claim 2, wherein the subframe is moved between first and second axial positions that are positively located relative to a mounting frame.

4. A method according to claim 1, further comprising adjusting the angle of inclination of said upstanding member so as to vary the spacing between successive yarn turns.

5. A method according to claim 4, wherein the said angle of inclination is adjusted by a control knob operatively connected to an eccentric cam on a mounting for said upstanding member so as to vary the inclination of said upstanding member.

* * * * *